US007873513B2

(12) United States Patent
Murgia et al.

(10) Patent No.: US 7,873,513 B2
(45) Date of Patent: Jan. 18, 2011

(54) SPEECH TRANSCODING IN GSM NETWORKS

(75) Inventors: Carlo Murgia, Aliso Viejo, CA (US); Yang Gao, Mission Viejo, CA (US); Aruna Vittal, Irvine, CA (US); Eyal Shlomot, Long Beach, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 864 days.

(21) Appl. No.: 11/825,424

(22) Filed: Jul. 6, 2007

(65) Prior Publication Data

US 2009/0012784 A1 Jan. 8, 2009

(51) Int. Cl.
*G10L 19/12* (2006.01)

(52) U.S. Cl. ..... 704/221; 704/219

(58) Field of Classification Search ..... 704/219, 704/221–230

See application file for complete search history.

(56) References Cited

U.S. PATENT DOCUMENTS

| | | | | |
|---|---|---|---|---|
| 2005/0136900 | A1 * | 6/2005 | Kim et al. | 455/414.4 |
| 2006/0074644 | A1 * | 4/2006 | Suzuki et al. | 704/223 |
| 2008/0160987 | A1 * | 7/2008 | Wang et al. | 455/422.1 |
| 2010/0223053 | A1 * | 9/2010 | Sandgren et al. | 704/219 |

FOREIGN PATENT DOCUMENTS

| | | | |
|---|---|---|---|
| EP | 1 288 913 A | 5/2003 | |
| WO | WO 2007/064256 | 7/2007 | |

OTHER PUBLICATIONS

*3rd Generation Partnership Project; Technical Specification Group Services and System Aspects; Mandatory speech codec speech processing functions; Adaptive Multi-Rate (AMR) speech codec frame structure (Release 6)*, 3GPP TS 26.101 V6.0.0 (Sep. 2004).

*3rd Generation Partnership Project; Technical Specification Group Services and System Aspects; Comfort noise aspects for Enhanced Full Rate (EFR) speech traffic channels (Release 6)*, 3GPP TS 46.062 V6.0.0 (Dec. 2004).

(Continued)

*Primary Examiner*—Abul Azad
(74) *Attorney, Agent, or Firm*—Farjami & Farjami LLP

(57) ABSTRACT

There is provided a method of transcoding an Enhance Full Rate (EFR) 12.2 Kbps encoded frame into an Adaptive Multi-Rate (AMR) 12.2 Kbps encoded frame, where the method comprises receiving the EFR 12.2 Kbps encoded frame from a first codec; determining if the EFR 12.2 Kbps encoded frame is a Silence Insertion Descriptor (SID) frame; if the EFR 12.2 Kbps encoded frame is determined to be the SID frame, the method further comprises transcoding the EFR SID frame. There is also provided a method of transcoding an EFR 12.2 Kbps encoded frame into an AMR 12.2 Kbps encoded frame, where the method comprises receiving the AMR 12.2 Kbps encoded frame from a first codec; determining if the AMR 12.2 Kbps encoded frame is an SID frame; if the AMR 12.2 Kbps encoded frame is determined to be the SID frame, the method further comprises transcoding the AMR SID frame.

14 Claims, 6 Drawing Sheets

OTHER PUBLICATIONS

*3rd Generation Partnership Project; Technical Specification Group Services and System Aspects; Mandatory speech codec speech processing functions; Adaptive Multi-Rate (AMR) speech codec; Comfort noise aspects (Release 6)*, 3GPP TS 26.092 V6.0.0, 1-13 (Dec. 2004).

*Digital cellular telecommunications system (Phase 2+); Enhanced full rate speech transcoding (3PP TS 46.060 version 6.0.0 Release 6)*, ETSI TS 146 060 V6.0.0 (Dec. 2004).

* cited by examiner

SPEECH TRANSCODING IN GSM NETWORKS

BACKGROUND OF THE INVENTION

1. Field of the Invention

The present invention generally relates to speech processing and coding and, more particularly, to transcoding of coded speech signals.

2. Background Art

The explosive growth of the cellular communications has been accompanied by many challenges facing the expansion of cellular networks having the need to connect diverse types of cellular devices with greater effectiveness. More specifically, because different cellular devices may be using different standards to encode, compress or packetize speech, a transcoding procedure has to be performed in order for a meaningful connection between cellular devices to be achieved. Typically, voice data encoded according to one standard from a transmitting participant communicating in one network has to be converted to the standard used by the receiving participant communicating under the guidelines of another network. For example, a transmitting participant's speech may be encoded according to EVRC specifications while the receiving participant uses AMR. In order for the data from the transmitting participant to be understood by the receiving participant, the bit-stream from the transmitting participant has to be converted from EVRC format to AMR format.

In conventional transcoding approaches, encoded data from the transmitting participant is decoded according to the coding method used by the transmitting participant. The decoded data is then re-encoded in accordance with the coding method used by the receiving participant. In the re-encoded form, the data is transmitted to the receiving participant. Known transcoding schemes, however, suffer numerous serious inadequacies. For example, the decoding and re-encoding of the speech signal (a "tandem" process), reduces the quality of the speech. For example, the tandem operation of the post-filter, common in low bit-rate speech decoders, can generate objectionable spectral distortion and degrade the speech quality significantly.

Another drawback of known transcoding schemes is the undesirable delay resulting from the re-encoding step. Typically, re-encoding of the decoded bit-stream requires that the speech signal characteristics be evaluated. As such, parameters including energy, spectral characteristics and pitch, for example, have to be extracted from the bit-stream and used to re-encode the signal. Often, such evaluation is also performed on a look-ahead portion of the signal, which increases the delay. Furthermore, in addition to delay, the need to extract these parameters as part of the re-encoding step can introduce inaccuracy in the extraction of the parameters and greater complexity to the system.

Today, a specific problem arises for transcoding in GSM (Global Systems for Mobile Communications) when transcoding between EFR (Enhanced Full Rate) coded speech and AMR (Adaptive Multi-Rate) coded speech at 12.2 Kbps involving Silence Insertion Descriptor (SID) frames. By way background, when active periods of speech are detected by voice activity detector (VAD), EFR and AMR (at 12.2 Kbps mode) use 12.2 Kbps to code the active speech. However, when inactive periods of speech are detected by the VAD, EFR and AMR encoders can choose to send an information update called a silence insertion descriptor (SID) to the inactive decoder, or to send nothing. This technique is named discontinuous transmission (DTX). Completely muting the output during inactive speech segments will create sudden drops of the signal energy level which are perceptually unpleasant. Therefore, in order to fill these inactive speech segments, a description of the background noise (i.e. the SID) is sent from the EFR or AMR encoder to the decoder. Using the SID, the decoder generates an output signal, which is perceptually equivalent to the background noise in the encoder. Such a signal is commonly called comfort noise, which is generated by a comfort noise generator (CNG) within the decoder.

Although EFR and AMR bitstreams for coded active speech at 12.2 Kbps are similar and compatible in all aspects, EFR and AMR bitstreams diverge and are different for the SID frames which represent inactive speech. For example, AMR specification defines a 39-bit SID frame for 2G and 3G networks, whereas EFR specification defines a 244-bit SID frame for 2G networks and a 43-bit SID frame for 3G networks. The undesirable effects of this incompatibility are explained below with reference to FIG. 1.

FIG. 1 illustrates conventional communication system 100, which includes first gateway (or GW1) 120 and second gateway (or GW2) 130, which may operate in a Tandem Free Operation (or TFO) network, which is described in 3GPP TS 28.062 V6.3.0 (2006-09), entitled "Inband Tandem Free Operation (TFO) of Speech Codecs," which is hereby incorporated by reference in its entirety in the present application. Communication system 100 also includes first mobile codec 110 and second mobile codec 140 in communication via GW1 120 and GW2 130. According to TFO networks, assuming first mobile codec 110 is operating in EFR 12.2 Kbps mode, the EFR 12.2 Kbps encoder generates a coded-speech input bitstream 112, which is transmitted by first mobile codec 110 to GW1 120. Within GW1 120, EFR 12.2 Kbps decoder 122 decodes stream in 112 and generates decoded speech 123, which is provided to G.711 encoder 126 to generate G.711 encoded speech 127. Bit stealing module 124 receives G.711 encoded speech 127 and also receives stream in 112 from first mobile codec 110. Bit stealing module 124 alters G.711 encoded speech 127 by allocating a few bits from each sample of G.711 encoded speech 127, such as two bits per sample, for transmission of bits from stream in 112, generating TDM speech+stream 125. TDM speech+stream 125, which includes both altered G.711 encoded speech 127 and bits from stream in 112, is transmitted from GW1 120 to GW2 130.

At the other end of the TDM network, upon receipt of TDM speech+stream 125 by GW2 130, the allocated bits which represent stream in 112 are provided to stream extractor 134 to generate stream 111. The other bits, which represent the altered G.711 encoded speech 127 are decoded by G.711 decoder 128 to generate decoded G.711 speech 129, which is provided to AMR 12.2 Kbps encoder 132 for encoding the according to AMR 12.2 Kbps specifications to generate stream out 131. TFO switch 135 can make a choice and to send either stream 131 or stream 111 as stream out 136, which is then decoded and by AMR 12.2 Kbps decoder in mobile codec 140. Sending stream 111 will provide better speech quality at the output of mobile codec 140, since it does not involve the tandem decoding and encoding in GW1 120 and GW2 130. The advantage of this TFO configuration is that if GW2 130 does not implement the TFO functionality, it can still receive TDM speech+stream 125 and operate with mobile codec 140, which means the GW1 120 can communicate with both TFO-enable gateways as well as with TFO-unable gateways. However, when SID frames are utilized there is no compatibility between EFR 12.2 Kbps coded speech and AMR 12.2 Kbps coded speech. As a result, the only way for communication system 100 to perform properly is for TFO switch to send stream 131 as stream out 136, which introduces tandem coding, and considerable delay and overhead for communication system 100. Moreover, Transcoder Free Operation (or TrFO), in which stream in 112 is transmitted directly to stream out 136 over packet network, can not be used at all when SID frames are utilized. TrFO is described in 3GPP TS 23.153 V7.2.0 (2007-03), entitled "Out of Band Transcoder Control," which is hereby incorporated by reference in its entirety in the present application.

Thus, there is an intense need in the art for an efficient transcoding method, and related system, which can overcome the shortcomings in the art relating to EFR 12.2 Kbps and AMR 12.2 Kbps coded speech.

SUMMARY OF THE INVENTION

There is provided methods and systems for transcoding of EFR 12.2 Kbps and AMR 12.2 Kbps coded speech, substantially as shown in and/or described in connection with at least one of the figures, as set forth more completely in the claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
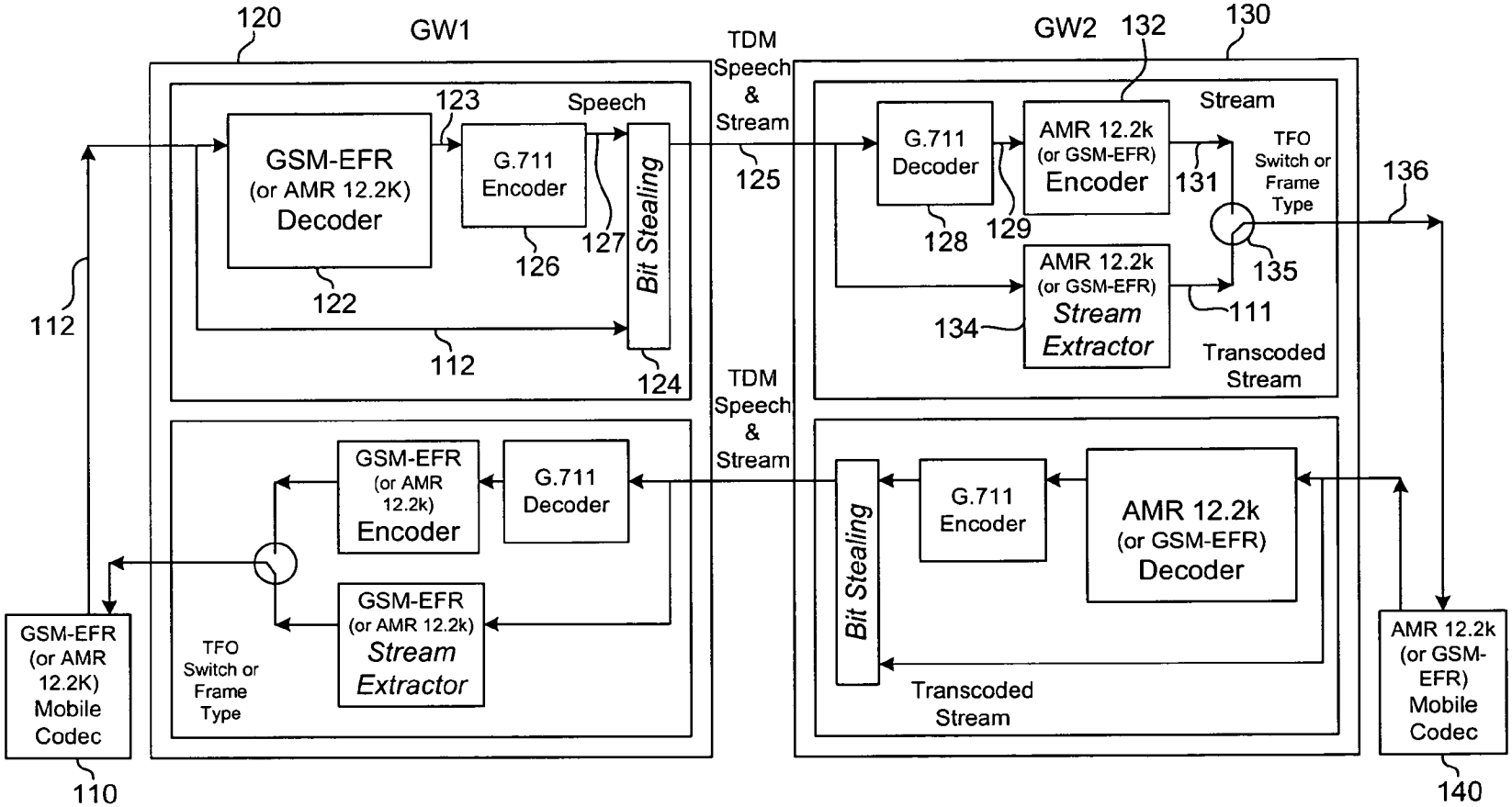
FIG. 1 illustrates a conventional communication system, including a first mobile codec, a first gateway, a second gateway and a second mobile codec, which may operate in a TFO network.

The present invention is directed to extending the battery life of wireless telephones by adapting power consumption. Although the invention is described with respect to specific embodiments, the principles of the invention, as defined by the claims appended herein, can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

Figure 2:
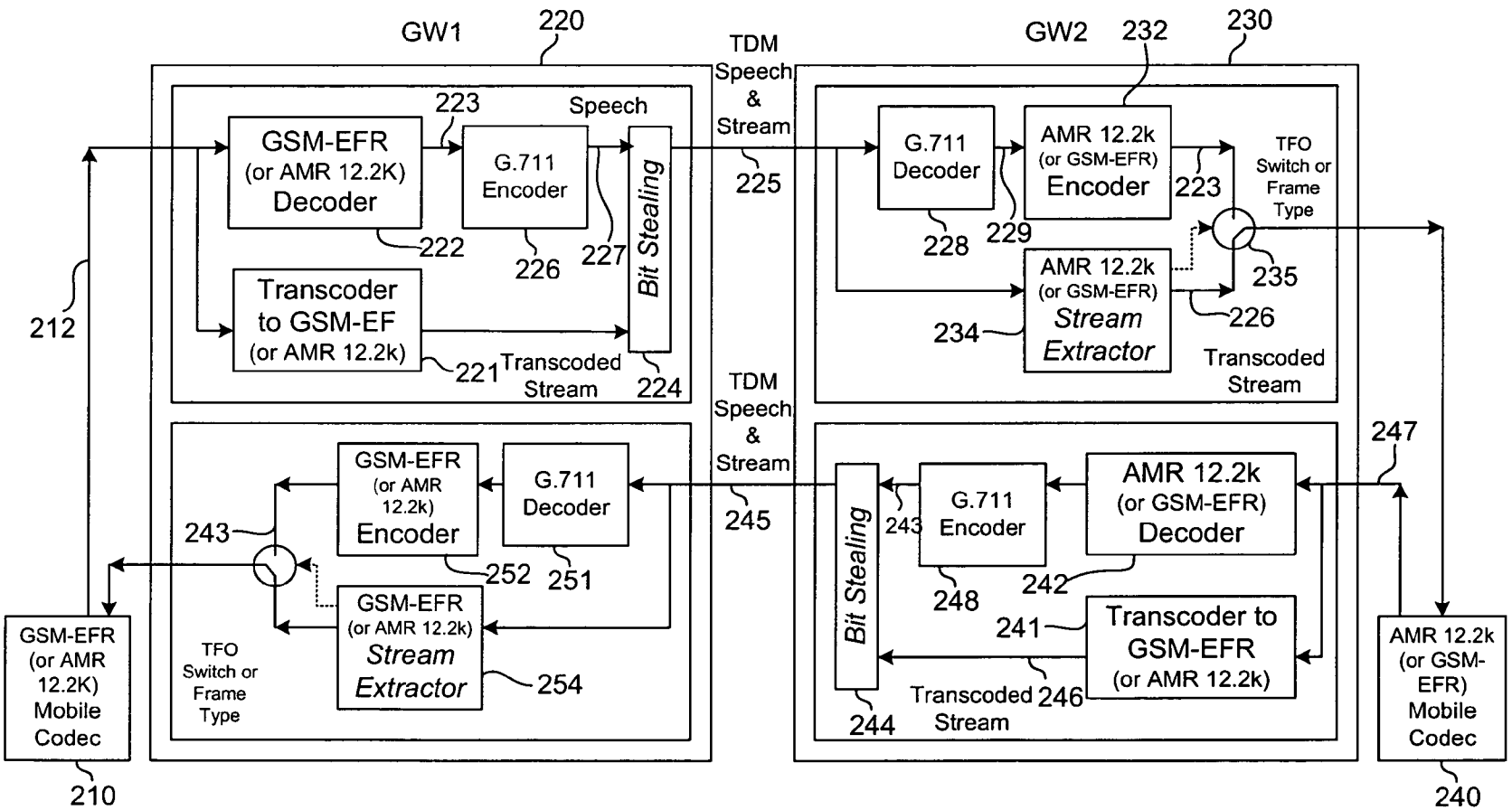
FIG. 2 illustrates a communication system, including a first mobile codec, a first gateway, a transcoder, a second gateway and a second mobile codec, which may operate in a TFO network, according to one embodiment of the present invention.

FIG. 2 illustrates communication system 200, which includes first gateway (or GW1) 220 and second gateway (or GW2) 230, which may operate in a TFO network, in accordance with one embodiment of the present invention. Communication system 200 also includes first mobile codec 210 and second mobile codec 240 in communication via GW1 220 and GW2 230. According to TFO networks, assuming first mobile codec 210 is operating in EFR 12.2 Kbps mode, the EFR 12.2 Kbps encoder generates a coded-speech input bitstream 212, which is transmitted by first mobile codec 210 to GW1 220. As shown, GW1 220 includes EFR 12.2 Kbps decoder 222, first transcoder 221, first G.711 encoder 226 and first bit stealing module 224. EFR 12.2 Kbps decoder 222 decodes coded-speech bitstream 212 and generates decoded speech 223, which is provided to G.711 encoder 226 to generate G.711 encoded speech 227. Further, first transcoder 221 receives the coded-speech input bitstream 212 and applies an EFR-to-AMR transcoding algorithm, described below in conjunction with FIG. 5, to the EFR 12.2 Kbps coded-speech bitstream 212, and generates first transcoded bitstream 226. As explained above, the coded speech for EFR 12.2 Kbps and the coded speech for AMR 12.2 Kbps are compatible for the most part, and first transcoder 221 is configured to detect the SID frames in the EFR 12.2 Kbps coded speech frames and apply the EFR-to-AMR transcoding algorithm to the SID frames, such that EFR SID frames are transformed into AMR SID frames.

While receiving decoded speech 223, first bit stealing module 224 also receives first transcoded bitstream 226 from first transcoder 221. Bit stealing module 224 alters G.711 encoded speech 227 by allocating a few bits from each sample of G.711 encoded speech 227, such as two bits per sample, for transmission of bits from first transcoded bitstream 226, generating TDM speech+stream 225.

At the other end of the packet network, upon receipt of TDM speech+stream 225 by GW2 230, the allocated bits that represent first transcoded bitstream 226 are provided to first stream extractor 234 to. The other bits, which represent the altered G.711 encoded speech 227 are decoded by first G.711 decoder 228 to generate decoded G.711 speech and the decoded G.711 speech is provided to AMR 12.2 Kbps encoder 232 for encoding the decoded G.711 speech according to AMR 12.2 Kbps specifications. TFO switch 235 can make a choice to send either stream 223 or 226, which is then decoded by AMR 12.2 Kbps decoder in second mobile coded 240. Turning back to stream extractor 234, unlike conventional communication system 100, where the EFR 12.2 Kbps SID frames cannot be processed by the AMR 12.2 Kbps decoder in second mobile codec 240, this problem in conventional commutation system 100 is overcome in commutation system 200. It should be noted that, in an alternative embodiment, first transcoder 221 may be placed in GW2 230 rather than GW1 220 and, in such event, first transcoder 221 may receive bitstream 226 from first stream extractor 234. As a result, in such alternative embodiment, TDM speech+stream 225 would be similar to TDM speech+stream 125; however, the EFR-to-AMR transcoding algorithm is applied in GW2 230 subsequent to extraction of bitstream 226 by first bitstream extractor 234.

Continuing with FIG. 2, assuming second mobile codec 240 is operating in AMR 12.2 Kbps mode, an AMR 12.2 Kbps encoder generates an AMR 12.2 Kbps coded-speech bitstream 247, which is transmitted by second mobile codec 240 to GW2 230. As shown, GW2 230 includes AMR 12.2 Kbps decoder 242, second transcoder 241, second G.711 encoder 248 and second bit stealing module 244. AMR 12.2 Kbps decoder 242 decodes the coded-speech bitstream 247 and generates AMR 12.2 Kbps decoded speech, which is provided to second G.711 encoder 248 and then to second bit stealing module 244 as encoded G.711 speech 243. Further, second transcoder 241 receives the AMR 12.2 Kbps coded-speech bitstream 247 and applies an AMR-to-EFR transcoding algorithm, described below in conjunction with FIG. 6, to the AMR 12.2 Kbps coded-speech bitstream 247, and generates second transcoded bitstream 246. As explained above, the coded speech for AMR 12.2 Kbps and the coded speech for EFR 12.2 Kbps are compatible for the most part, and second transcoder 241 is configured to detect the SID frames in the AMR 12.2 Kbps coded speech frames and apply the AMR-to-EFR transcoding algorithm to the SID frames, such that AMR SID frames are transformed into EFR SID frames.

While receiving decoded G.711 speech 243 from second G.711 encoder 246, bit stealing module 244 also receives second transcoded bitstream 246 from second transcoder 241. Bit stealing module 244 encodes decoded G.711 encoded speech 243 using a toll quality codec, such as a G.711 codec, for packetization and transmission over the packet network. While packetizing the G.711 coded speech, bit stealing module 244 further allocates a few bits of each data packet, such as two bits for frame, for transmission of bits from second transcoded bitstream 246 in TDM speech+stream 245.

At the other end of the packet network, upon receipt of TDM speech+stream 245 by GW1 220, TDM speech+stream 245 is decoded by second G.711 decoder 251 and the allocated bits for second transcoded bitstream 246 are provided to second stream extractor 254. Further, other packetized bits are decoded using a G.711 decoder (not shown) to generate decoded G.711 speech and the decoded G.711 speech is provided to EFR 12.2 Kbps encoder 252 for encoding the decoded G.711 speech according to EFR 12.2 Kbps specifications. Turning back to stream extractor 254, unlike conventional communication system 100, where the AMR 12.2 Kbps SID frames cannot be processed by the EFR 12.2 Kbps decoder in first mobile codec 210, this problem in conventional commutation system 100 is overcome in commutation system 200. It should be noted that, in an alternative embodiment, second transcoder 241 may be placed in GW1 220 rather than GW2 230 and, in such event, second transcoder 241 may receive bitstream 246 from second stream extractor 244. As a result, the AMR-to-EFR transcoding algorithm is applied by GW1 220 subsequent to extraction of bitstream 246 by second bitstream extractor 254.

Figure 3:
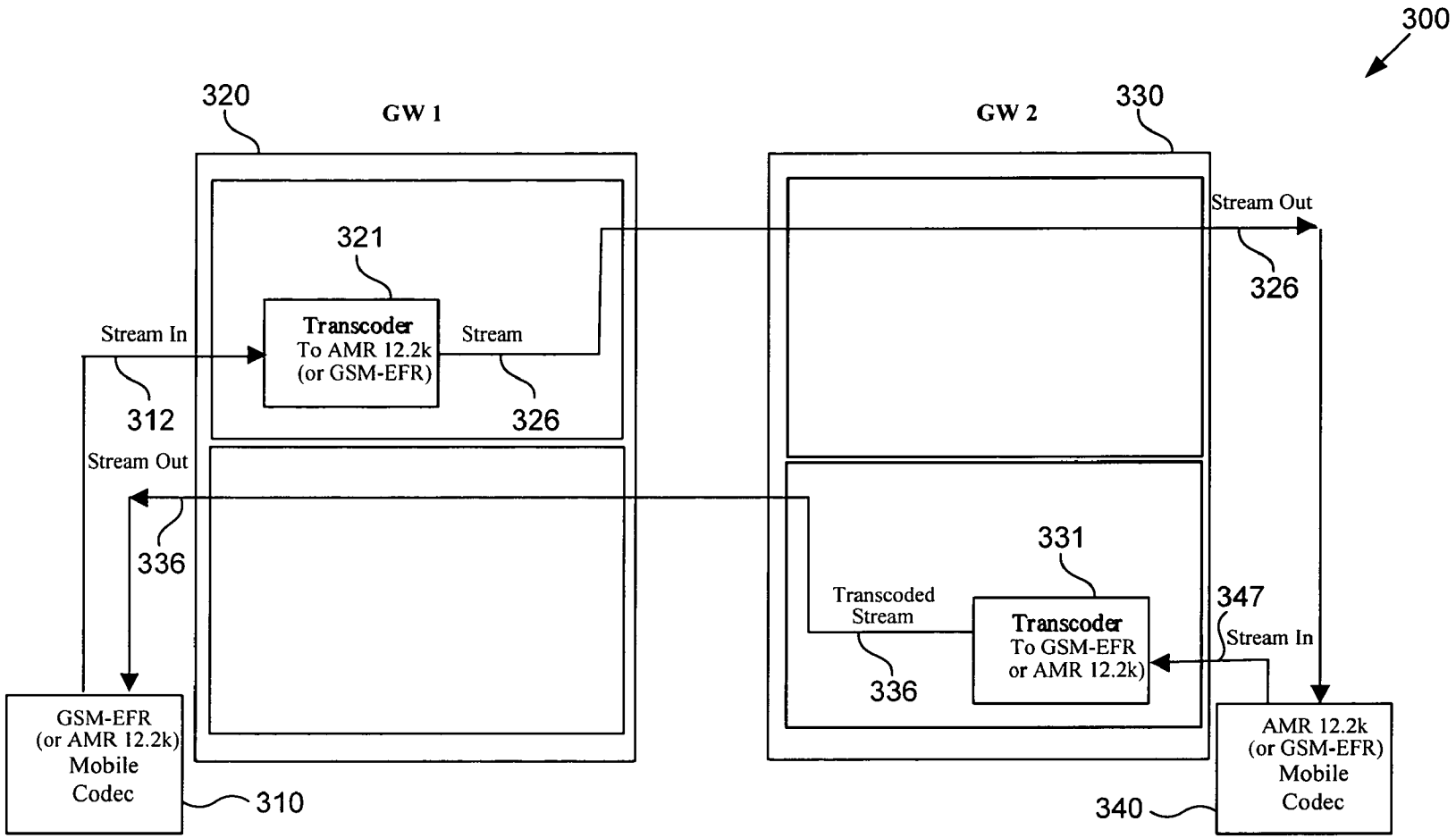
FIG. 3 illustrates a communication system, including a first mobile codec, a first gateway having a transcoder, a second gateway and a second mobile codec, which may operate in a TFO network, according to one embodiment of the present invention.

FIG. 3 illustrates communication system 300, which includes first gateway (or GW1) 320 and second gateway (or GW2) 330, which may operate in a TrFO network, in accordance with one embodiment of the present invention. Communication system 300 also includes first mobile codec 310 and second mobile codec 340 in communication via GW1 320 and GW2 330. Assuming first mobile codec 310 is operating in EFR 12.2 Kbps mode, an EFR 12.2 Kbps encoder generates an EFR 12.2 Kbps coded-speech stream 312, which is transmitted by first mobile codec 310 to GW1 320. As shown, GW1 320 includes first transcoder 321, which receives the EFR 12.2 Kbps coded-speech bitstream 312 and applies an EFR-to-AMR transcoding algorithm, described below in conjunction with FIG. 5, to the EFR 12.2 Kbps coded-speech bitstream 312, and generates first transcoded bitstream 326. First transcoder 321 is configured to detect the SID frames in the EFR 12.2 Kbps coded speech frames and apply the EFR-to-AMR transcoding algorithm to the SID frames, such that EFR SID frames are transformed into AMR SID frames. Thereafter, GW1 320 packetizes and transmits first transcoded bitstream 326 over the packet network to GW2 330.

At the other end of the packet network, upon receipt of first transcoded bitstream 326 by GW2 330, first transcoded bitstream 326 is depacketized and provided to the AMR 12.2 Kbps decoder in second mobile codec 340 for decoding first transcoded bitstream 326. [Same comment as above] Unlike conventional TrFO communication systems, where the EFR SID frames in bitstream 312, which are passed through without transcoding cannot be processed by the AMR 12.2 Kbps decoder in second mobile codec 340 and thus cannot work, EFR SID frames are transcoded by first transcoder 312 to be transformed into AMR SID frames. It should be noted that, in an alternative embodiment, first transcoder 321 may be placed in GW2 330 instead, and may receive bitstream 312 from GW1 320 over the packet network.

Continuing with FIG. 3, assuming second mobile codec 340 is operating in AMR 12.2 Kbps mode, an AMR 12.2 Kbps encoder in second mobile codec 340 generates an AMR 12.2 Kbps coded-speech bitstream 347, which is transmitted by second mobile codec 340 to GW2 340. As shown, GW2 340 includes second transcoder 331, which receives the AMR 12.2 Kbps coded-speech bitstream 347 and applies an AMR-to-EFR transcoding algorithm, described below in conjunction with FIG. 6, to the AMR 12.2 Kbps coded-speech bitstream 347, and generates second transcoded bitstream 336. Second transcoder 331 is configured to detect the SID frames in the AMR 12.2 Kbps coded speech frames and apply the AMR-to-EFR transcoding algorithm to the SID frames, such that AMR SID frames are transformed into EFR SID frames. Thereafter, GW2 340 packetizes and transmits second transcoded bitstream 336 over the packet network to GW1 320.

At the other end of the packet network, upon receipt of second transcoded bitstream 336 by GW1 320, second transcoded bitstream 336 is depacketized and provided to the EFR 12.2 Kbps decoder in first mobile codec 341 for decoding first transcoded bitstream 336. Unlike conventional TrFO communication systems, where the AMR SID frames in bitstream 347, which are passed through without transcoding, cannot be processed by the EFR 12.2 Kbps decoder in first mobile codec 310 and thus cannot work, EFR SID frames are transcoded by second transcoder 331 to be transformed into EFR SID frames. It should be noted that, in an alternative embodiment, second transcoder 331 may be placed in GW1 320 instead, and may receive bitstream 347 from GW2 330 over the packet network.

Figure 4:
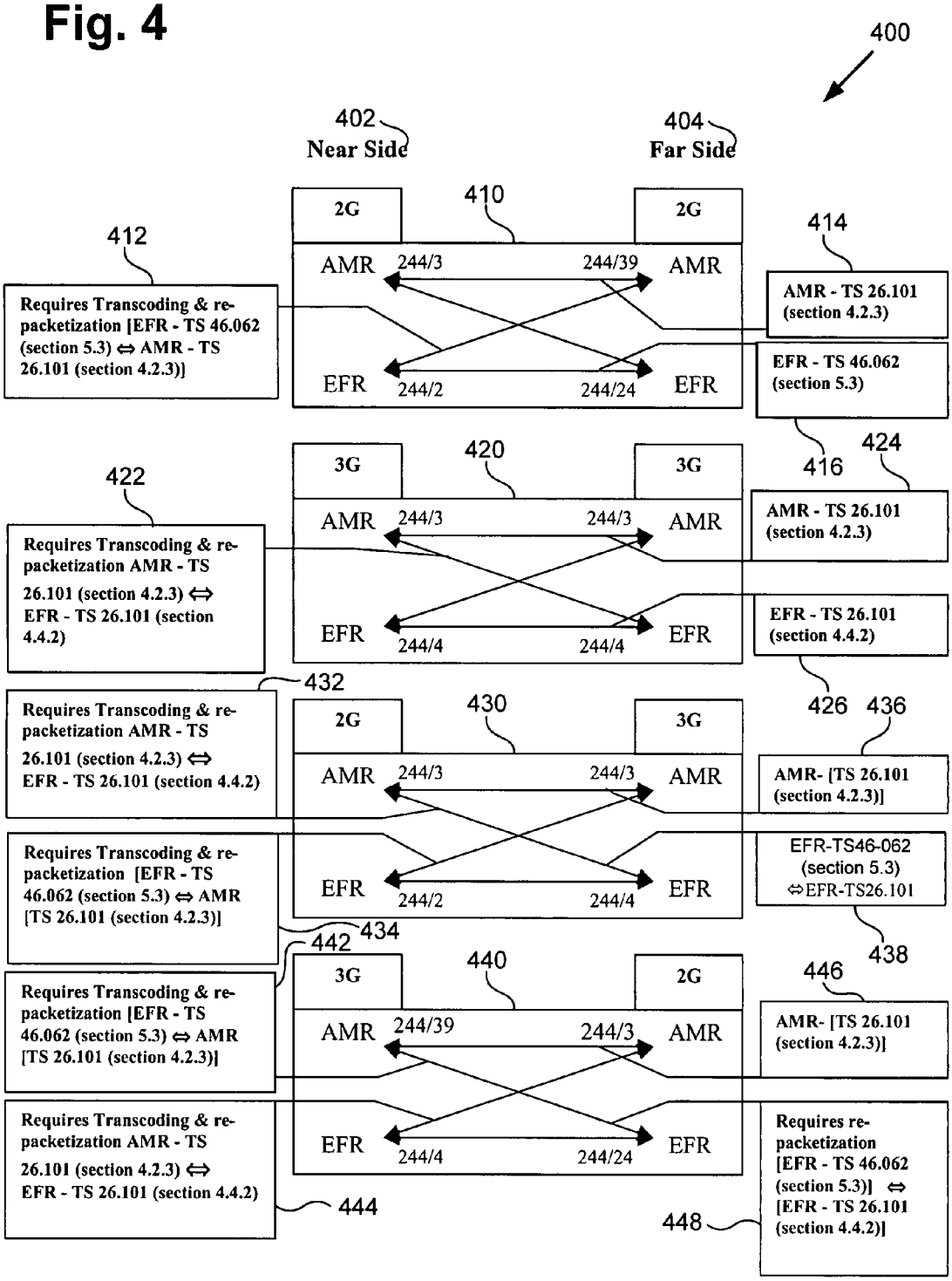
FIG. 4 illustrates a transcoding diagram for transcoding between EFR 12.2 Kbps and AMR 12.2 Kbps in 2G and 3G networks, according to one embodiment of the present invention.

FIG. 4 illustrates transcoding diagram 400 for transcoding between EFR 12.2 Kbps and AMR 12.2 Kbps in 2G and 3G networks, according to one embodiment of the present invention. In FIG. 4, the notation yyy/zzz denotes that yyy bits are used for active speech coding and zzz bits are used for inactive speech SID coding. Moreover, since both EFR and AMR 12.2 Kbps always use 244 bits for active speech, yyy is always 244 in FIG. 4. Turning to communication system 410, near side codec 402 and far side codec 404 are shown to be both operating in a 2G network, where EFR uses 244 bits for SID and AMR uses 39 bits for SID. In the event that near side codec 402 is operating in EFR 12.2 Kbps mode and far side codec 404 is operating in AMR 12.2 Kbps mode, block 412 illustrates that 244 bits of a 2G-EFR SID frame will be transcoded into 39 bits of an AMR SID frame, and vice versa. The 244 bits of the 2G-EFR SID frame are defined at Section 5.3 of 3GPP TS 46.062, V6.0.0 (2004-12), entitled "Comfort Noise Aspects for Enhanced Full Rate (EFR)," and Section 7 of 3GPP TS 46.060, V6.0.0 (2004-12), entitled "Enhanced Full Rate (EFR) Speech Transcoding," which documents are hereby incorporated by reference in their entirety in the present application. Further, the 39 bits of the AMR SID frame are defined at Section 4.2.3 of 3 GPP TS 26.101, V6.0.0 (2004-09), entitled "Adaptive Multi-Rate (AMR) Speech Codec Frame Structure," and Section 7 of 3GPP TS 26.092, V6.0.0 (2004-12), entitled "Adaptive Multi-Rate (AMR) Speech Codec Comfort Noise Aspects," which documents are hereby incorporated by reference in their entirety in the present application. In addition, blocks 414 and 416 show that no transcoding is necessary where both near side codec 402 and far side codec 404 are operating in AMR 12.2 Kbps mode or EFR 12.2 Kbps mode, respectively.

Referring to communication system 420, near side codec 402 and far side codec 404 are shown to be both operating in a 3G network, where EFR uses 43 bits for SID and AMR uses 39 bits for SID. In the event that near side codec 402 is operating in EFR 12.2 Kbps mode and far side codec 404 is operating in AMR 12.2 Kbps mode, block 412 illustrates that 43 bits of a 3G-EFR SID frame will be transcoded into 39 bits of an AMR SID frame, and vice versa. The 43 bits of the 3G-EFR SID frame are defined at Section 4.4.2 of 3GPP TS 26.101, V6.0.0 (2004-09), entitled "Adaptive Multi-Rate (AMR) Speech Codec Frame Structure." In addition, blocks 424 and 426 show that no transcoding is necessary where both near side codec 402 and far side codec 404 are operating in AMR 12.2 Kbps mode or EFR 12.2 Kbps mode, respectively.

With reference to communication system 430, near side codec 402 is shown to be operating in a 2G network and far side codec 404 is shown to be operating in a 3G network. In the event that near side codec 402 is operating in AMR 12.2 Kbps mode and far side codec 404 is operating in EFR 12.2 Kbps mode, block 432 illustrates that 43 bits of a 3G-EFR SID frame will be transcoded into 39 bits of an AMR SID frame, and vice versa. Further, in the event that near side codec 402 is operating in EFR 12.2 Kbps mode and far side codec 404 is operating in AMR 12.2 Kbps mode, block 434 illustrates that 244 bits of a 2G-EFR SID frame will be transcoded into 39 bits of an AMR SID frame, and vice versa. In addition, block 436 shows that no transcoding is necessary where both near side codec 402 and far side codec 404 are operating in AMR 12.2 Kbps mode. Also, block 438 shows that no transcoding is necessary where both near side codec 402 and far side codec 404 are operating in EFR 12.2 Kbps mode, except that the 43 bits of the 3G-EFR SID frame must be re-packetized according to the format of the 244 bits of the 2G-EFR SID frame, and vice versa.

According to communication system 430, near side codec 402 is shown to be operating in a 3G network and far side codec 404 is shown to be operating in a 2G network. In the event that near side codec 402 is operating in AMR 12.2 Kbps mode and far side codec 404 is operating in EFR 12.2 Kbps mode, block 444 illustrates that 43 bits of a 3G-EFR SID frame will be transcoded into 39 bits of an AMR SID frame, and vice versa. Further, in the event that near side codec 402 is operating in EFR 12.2 Kbps mode and far side codec 404 is operating in AMR 12.2 Kbps mode, block 442 illustrates that 244 bits of a 2G-EFR SID frame will be transcoded into 39 bits of an AMR SID frame, and vice versa. In addition, block 446 shows that no transcoding is necessary where both near side codec 402 and far side codec 404 are operating in AMR 12.2 Kbps mode. Also, block 448 shows that no transcoding is necessary where both near side codec 402 and far side codec 404 are operating in EFR 12.2 Kbps mode, except that the 43 bits of the 3G-EFR SID frame must be re-packetized according to the format of the 244 bits of the 2G-EFR SID frame, and vice versa.

Figure 5:
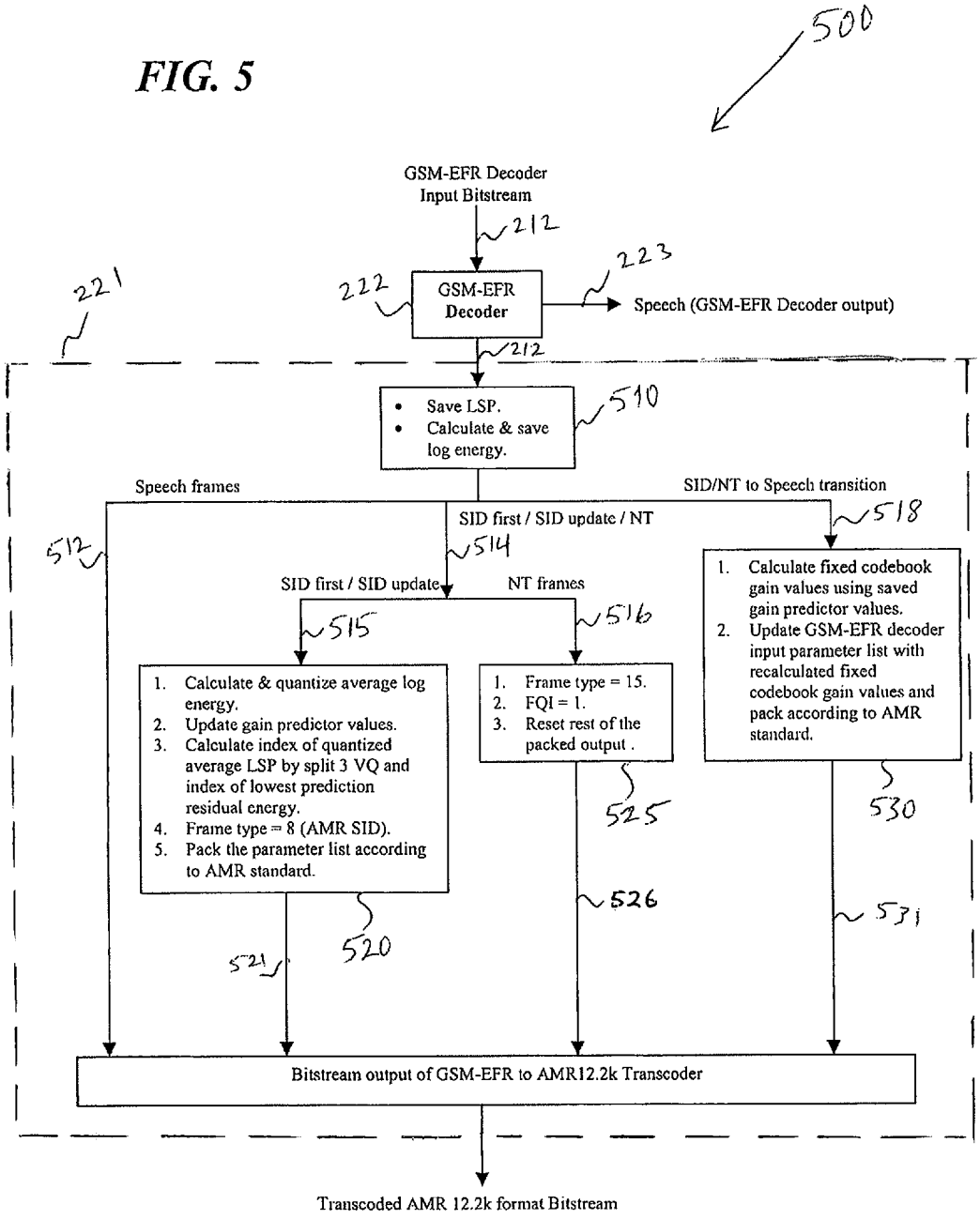
FIG. 5 illustrates a transcoding flow diagram for transcoding from EFR 12.2 Kbps encoded bitstream to AMR 12.2 Kbps encoded bitstream, according to one embodiment of the present invention.

FIG. 5 illustrates transcoding flow diagram 500 for transcoding from EFR 12.2 Kbps encoded bitstream to AMR 12.2 Kbps encoded bitstream, according to one embodiment of the present invention. As shown in FIG. 5, first decoder 222 receives the EFR 12.2 Kbps coded-speech bitstream 212, and outputs decoded speech 223. Similarly, first transcoder 221 also receives the EFR 12.2 Kbps coded-speech bitstream 212. First transcoder 221 exploits the fact that the active speech frame processing of both AMR 12.2 Kbps mode and EFR 12.2 Kbps are identical, so there is no requirement to transcode all the frames of the EFR 12.2 Kbps coded-speech bitstream 212. As stated above, the only difference between the EFR 12.2 Kbps codec and the AMR 12.2 Kbps codec is the comfort noise aspect during discontinuous transmission, which is periodically encoded and sent as SID frames.

With reference to FIG. 5, at step 510, for every input frame of the EFR 12.2 Kbps coded-speech bitstream 212, first transcoder 221 saves the Line Spectral Pair (LSP) of $4^{th}$ sub-frame, and uses the post-filtered synthesis speech of first decoder 222 to calculate log energy based on frame energy. Next, if input frame of the EFR 12.2 Kbps coded-speech bitstream 212 is determined to be a speech frame, and not a transition from an SID or No Data (NT) to a speech frame, the speech frame is transmitted unaltered by first output bitstream 512 of first transcoder 221.

However, if input frame of the EFR 12.2 Kbps coded-speech bitstream 212 is determined to be a transition from SID/NT (or non-speech) to a speech frame, first transcoder 221 moves to step 530 to process speech frame 518. At step 530, first transcoder 221 calculates the fixed codebook gain for each sub-frame of speech frame 518, because the EFR 12.2 Kbps codec resets the past quantized energy levels during non-speech frames and uses them to calculate predicted energy and codebook gain, whereas the AMR 12.2 Kbps codec uses the past quantized energy levels to calculate predicted energy and codebook gain. Further, at step 530, first transcoder 221 updates input parameter list of first decoder 222 with the recalculated codebook gain values and packetizes the updated input parameter list according to the requirements of the AMR standard, as described in the incorporated documents in conjunction with FIG. 4, for transmission on second output bitstream 531 of first transcoder 221.

If input frame of the EFR 12.2 Kbps coded speech in bitstream 212 is determined to be non-speech frame 514, i.e. one of first SID or SID Update or NT, first transcoder 221 moves to step 520 to process first SID or SID Update frame 515 for a transition from speech to silence, or first transcoder 221 moves to step 525 to process NT frame 516. At step 520, when a transition from speech to SID or SID Update is detected, first transcoder 221 (a) calculates the average logarithmic energy and quantizes to six bits, (b) updates the gain predictor memory with new values that are to be used for non-speech to speech transition; (c) quantizes the average LSP parameters and split by three (3) vector quantization (split-VQ), also calculates the index corresponding to lowest prediction residual energy, (d) updates the input parameter list with AMR SID header (i.e. Frame type=8) in addition to above values, and (e) packetizes the updated input parameter list according to the requirements of the AMR standard, as described in the incorporated documents in conjunction with FIG. 4, for transmission on third output bitstream 521 of first transcoder 221. At step 525, when an NT frame is detected, first transcoder 221 (a) sets the Frame Type to 15, (b) sets the Frame Quality Indicator to 1, and (c) resets the rest of packed words, for transmission on third output bitstream 526 of first transcoder 221.

Figure 6:
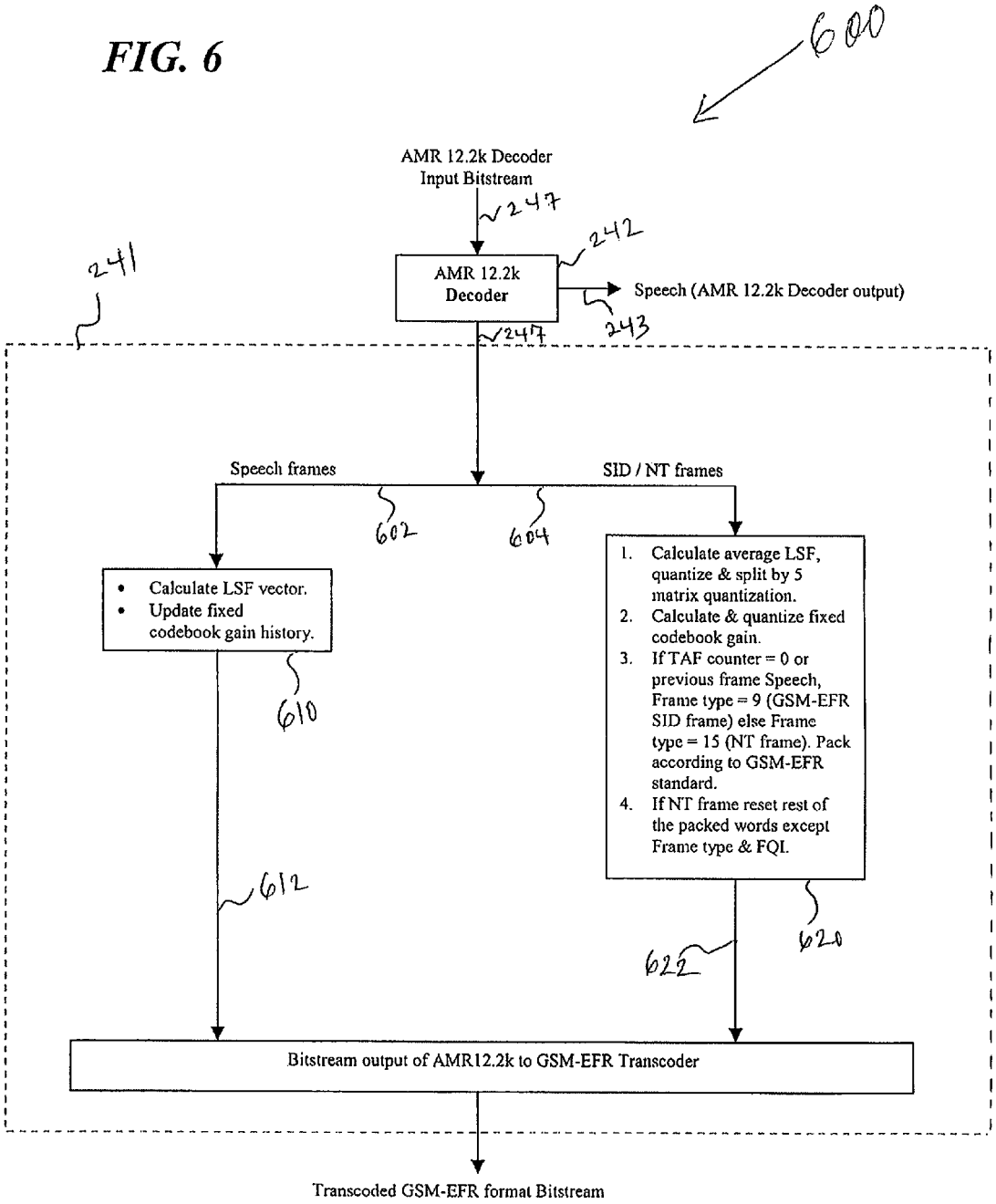
FIG. 6 illustrates a transcoding flow diagram for transcoding from AMR 12.2 Kbps encoded bitstream to EFR 12.2 Kbps encoded bitstream, according to one embodiment of the present invention.

FIG. 6 illustrates transcoding flow diagram 600 for transcoding from AMR 12.2 Kbps encoded bitstream to EFR 12.2 Kbps encoded bitstream, according to one embodiment of the present invention. As shown in FIG. 6, second decoder 242 receives the AMR 12.2 Kbps coded speech in bitstream 247, and outputs decoded speech 243. Similarly, second transcoder 241 also receives the AMR 12.2 Kbps coded speech in bitstream 247. Second transcoder 241 exploits the fact that the active speech frame processing of both AMR 12.2 Kbps mode and EFR 12.2 Kbps are identical, so there is no requirement to transcode all the frames of the AMR 12.2 Kbps coded speech in bitstream 247. As stated above, the only difference between the AMR 12.2 Kbps codec and the AMR 12.2 Kbps codec is the comfort noise aspect during discontinuous transmission, which is periodically encoded and sent as SID frames.

With reference to FIG. 6, if input frame of the AMR 12.2 Kbps coded speech in bitstream 247 is determined to be speech frame 602, second transcoder 241 moves to step 610 to process speech frame 602. At step 610, for every speech frame 602 of the AMR 12.2 Kbps coded speech in bitstream 247, second transcoder 241 (a) calculates the reference Line Spectral Frequency (LSF) vector by averaging the history of quantized LSF vectors, (b) updates the fixed codebook gain history with fixed codebook gains for the current frame, and (c) speech frame 602 is transmitted unaltered on first output bitstream 612 of first transcoder 241.

However, if input frame of the EFR 12.2 Kbps coded speech in bitstream 247 is determined to be SID or NT (or non-speech) frame 604, second transcoder 241 moves to step 620 to process non-speech frame 604. At step 620, second transcoder 241 (a) calculates the average of current LSF and LSF in history, quantized and split by five (5) matrix quantization, (b) calculates the unquantized fixed codebook gain based on the energy of the Linear Prediction (LP) residual signal and quantized, (c) sets the Frame type to 9 (i.e., EFR SID) if either Time Alignment Flag (TAF) counter has expired (SID update frame) or if non-speech frame 604 is the first SID frame after a speech frame, else sets the Frame type to 15 (i.e., NT frame), and (d) packetizes the parameters according to the requirements of the EFR standard, as described in the incorporated documents in conjunction with FIG. 4, for transmission on second output bitstream 622 of second transcoder 241. However, if input frame is an NT frame, second transcoder 241 resets the rest of packed words, of course, except Frame Type and the Frame Quality Indicator.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. For example, it is contemplated that the circuitry disclosed herein can be implemented in software, or vice versa. The described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A method of transcoding an Enhance Full Rate (EFR) 12.2 Kbps encoded frame into an Adaptive Multi-Rate (AMR) 12.2 Kbps encoded frame for use by a first gateway, the method comprising:

receiving the EFR 12.2 Kbps encoded frame from a first codec;

determining if the EFR 12.2 Kbps encoded frame is a Silence Insertion Descriptor (SID) frame;

if the EFR 12.2 Kbps encoded frame is determined to be the SID frame, the method further comprising:

calculating and quantizing an average log energy for the frame;

updating gain predictor values for the frame;

calculating index of quantized average Line Spectral Pair (LSP) by split three VQ and index of lowest prediction residual energy; and setting frame type to indicate an AMR SID frame.

2. The method of claim 1, wherein prior to the determining if the EFR 12.2 Kbps encoded frame is the SID frame, the method further comprising:

saving the LSP of fourth subframe; and using post-filtered synthesis of the frame to calculate log energy based on the frame energy.

3. The method of claim 1 further comprising:

determining if the EFR 12.2 Kbps encoded frame is a No Data (NT) frame;

if the EFR 12.2 Kbps encoded frame is determined to be the NT frame, the method further comprising:

setting a frame type to 15; and setting a frame quality indicator to 1.

4. The method of claim 1 further comprising:

determining if the EFR 12.2 Kbps encoded frame is a transition frame from SID or No Data (NT) to speech;

if the EFR 12.2 Kbps encoded frame is determined to be the transition frame, the method further comprising:

calculating fixed codebook gain values using save gain predictor values; and updating EFR parameter list with the fixed codebook gain values.

5. The method of claim 4 further comprising:

determining if the EFR 12.2 Kbps encoded frame is a speech frame;

if the EFR 12.2 Kbps encoded frame is determined to be the speech frame, the method further comprising: transmitting the speech frame unaltered.

6. A transcoder for transcoding an Enhance Full Rate (EFR) 12.2 Kbps encoded frame into an Adaptive Multi-Rate (AMR) 12.2 Kbps encoded frame, the transcoder comprising:

a receiver configured to receive the EFR 13.2 Kbps encoded frame from a first codec;

wherein the transcoder is configured to determine if the EFR 12.2 Kbps encoded frame is a Silence Insertion Descriptor (SID) frame, and wherein if the EFR 12.2 Kbps encoded frame is determined to be the SID frame, the transcoder is further configured to calculate and quantize an average log energy for the frame, update gain predictor values for the frame, calculate index of quantized average Line Spectral Pair (LSP) by split three VQ and index of levied lowest prediction residual energy, and set frame type to indicate an AMR SID frame.

7. The transcoder of claim 6, wherein prior to the determining if the EFR 12.2 Kbps encoded frame is the SID frame, the transcoder is further configured to save the LSP of fourth subframe, and use post-filtered synthesis of the frame to calculate log energy based on the frame energy.

8. The transcoder of claim 6, wherein the transcoder is further configured to determine if the EFR 12.2 Kbps encoded frame is a No Data (NT) frame, and if the EFR 12.2 Kbps encoded frame is determined to be the NT frame, the transcoder is further configured to set a frame type to 15, and set a frame quality indicator to 1.

9. The transcoder of claim 6, wherein the transcoder is further configured to determine if the EFR 12.2 Kbps encoded frame is a transition frame from SID or No Data (NT) to speech, and if the EFR 12.2 Kbps encoded frame is determined to be the transition frame, the transcoder is further configured to calculate fixed codebook gain values using save gain predictor values, and update EFR parameter list with the fixed codebook gain values.

10. The transcoder of claim 9, wherein the transcoder is further configured to determine if the EFR 12.2 Kbps encoded frame is a speech frame, and if the EFR 12.2 Kbps encoded frame is determined to be the speech frame, the transcoder is further configured to transmit the speech frame unaltered.

11. A method of transcoding an Adaptive Multi-Rate (AMR) 12.2 Kbps encoded frame into an Enhance Full Rate (EFR) 12.2 Kbps encoded frame for use by a first gateway, the method comprising:

receiving the AMR 12.2 Kbps encoded frame from a first codec;

determining if the AMR 12.2 Kbps encoded frame is a Silence Insertion Descriptor (SID) frame;

if the AMR 12.2 Kbps encoded frame is determined to be the SID frame, the method further comprising:

calculating average of Line Spectral Frequency (LSF) of the frame, quantizing and splitting by five (5) matrix quantization;

calculating unquantized fixed codebook gain of the frame based on energy of Linear Prediction (LP) residual signal; and setting a frame type to indicate an EFR SID.

12. The method of claim 11 further comprising:

determining if the AMR 12.2 Kbps encoded frame is a speech frame;

if the AMR 12.2 Kbps encoded frame is determined to be the speech frame, the method further comprising:

calculating reference Line Spectral Frequency (LSF) vector by averaging a history of quantized LSF vectors; and updating fixed codebook gain history with fixed codebook gains for the speech frame.

13. A transcoder of transcoding an Adaptive Multi-Rate (AMR) 12.2 Kbps encoded frame into an Enhance Full Rate (EFR) 12.2 Kbps encoded frame, the transcoder comprising:

a receiver configured to receive the AMR 12.2 Kbps encoded frame from a first codec;

wherein the transcoder is configured to determine if the AMR 12.2 Kbps encoded frame is a Silence Insertion Descriptor (SID) frame, and if the AMR 12.2 Kbps encoded frame is determined to be the SID frame, the transcoder is further configured to calculate average of Line Spectral Frequency (LSF) of the frame, quantizing and splitting by five (5) matrix quantization, calculate unquantized fixed codebook gain of the frame based on energy of Linear Prediction (LP) residual signal, and set a frame type to indicate an EFR SID.

14. The transcoder of claim 13, wherein the transcoder is configured to determine if the AMR 12.2 Kbps encoded frame is a speech frame, and if the AMR 12.2 Kbps encoded frame is determined to be the speech frame, the transcoder is further configured to calculate reference Line Spectral Frequency (LSF) vector by averaging a history of quantized LSF vectors, and update fixed codebook gain history with fixed codebook gains for the speech frame.

* * * * *

UNITED STATES PATENT AND TRADEMARK OFFICE

CERTIFICATE OF CORRECTION

PATENT NO. : 7,873,513 B2
APPLICATION NO. : 11/825424
DATED : January 18, 2011
INVENTOR(S) : Murgia et al.

It is certified that error appears in the above-identified patent and that said Letters Patent is hereby corrected as shown below:

In the claims, column 10, line 55, “13.2” should be changed to --12.2--.

In the claims, column 10, line 65, “levied” should be deleted.

Signed and Sealed this
First Day of March, 2011

David J. Kappos

David J. Kappos
*Director of the United States Patent and Trademark Office*